US008965225B2

(12) United States Patent
Koyama

(10) Patent No.: US 8,965,225 B2
(45) Date of Patent: Feb. 24, 2015

(54) IMAGE-FORMING APPARATUS SETTING UPPER LIMIT OF ELECTRIC POWER BASED ON DETECTION RESULT OF SHEET DETECTOR

(71) Applicant: Tatsuya Koyama, Toyoake (JP)

(72) Inventor: Tatsuya Koyama, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/091,405

(22) Filed: Nov. 27, 2013

(65) Prior Publication Data

US 2014/0153949 A1 Jun. 5, 2014

(30) Foreign Application Priority Data

Nov. 30, 2012 (JP) ..... 2012-261989

(51) Int. Cl.
*G03G 15/20* (2006.01)

(52) U.S. Cl.
CPC ..... *G03G 15/2046* (2013.01)
USPC ..... 399/33

(58) Field of Classification Search
CPC ..... G03G 15/2039; G03G 2215/00772; G03G 15/205
USPC ..... 399/33, 44
See application file for complete search history.

(56) References Cited

U.S. PATENT DOCUMENTS

2006/0291883 A1* 12/2006 Chae ..... 399/69
2010/0014880 A1* 1/2010 Kinouchi et al. ..... 399/67

FOREIGN PATENT DOCUMENTS

JP 2008-134377 A 6/2008

* cited by examiner

*Primary Examiner* — Clayton E LaBalle
*Assistant Examiner* — Noam Reisner
(74) *Attorney, Agent, or Firm* — Banner & Witcoff, Ltd.

(57) ABSTRACT

In an image-forming apparatus, a sheet detector detects the recording sheet conveyed from the sheet accommodating unit by the pickup roller. A fixing unit includes a heating member configured to heat the recording sheet. A power supply unit supplies the heating member with electric power. A control device is configured to: output a signal controlling the pickup roller to convey the recording sheet from the sheet accommodating unit; determine, based on a detection result of the sheet detector, whether the pickup roller succeeds in conveying the recording sheet from the sheet accommodating unit; control the power supply unit to supply the heating member with the electric power such that the electric power per unit time does not exceed an upper limit; and set the upper limit depending on a determination result of whether the pickup roller succeeds in conveying the recording sheet from the sheet accommodating unit.

10 Claims, 6 Drawing Sheets

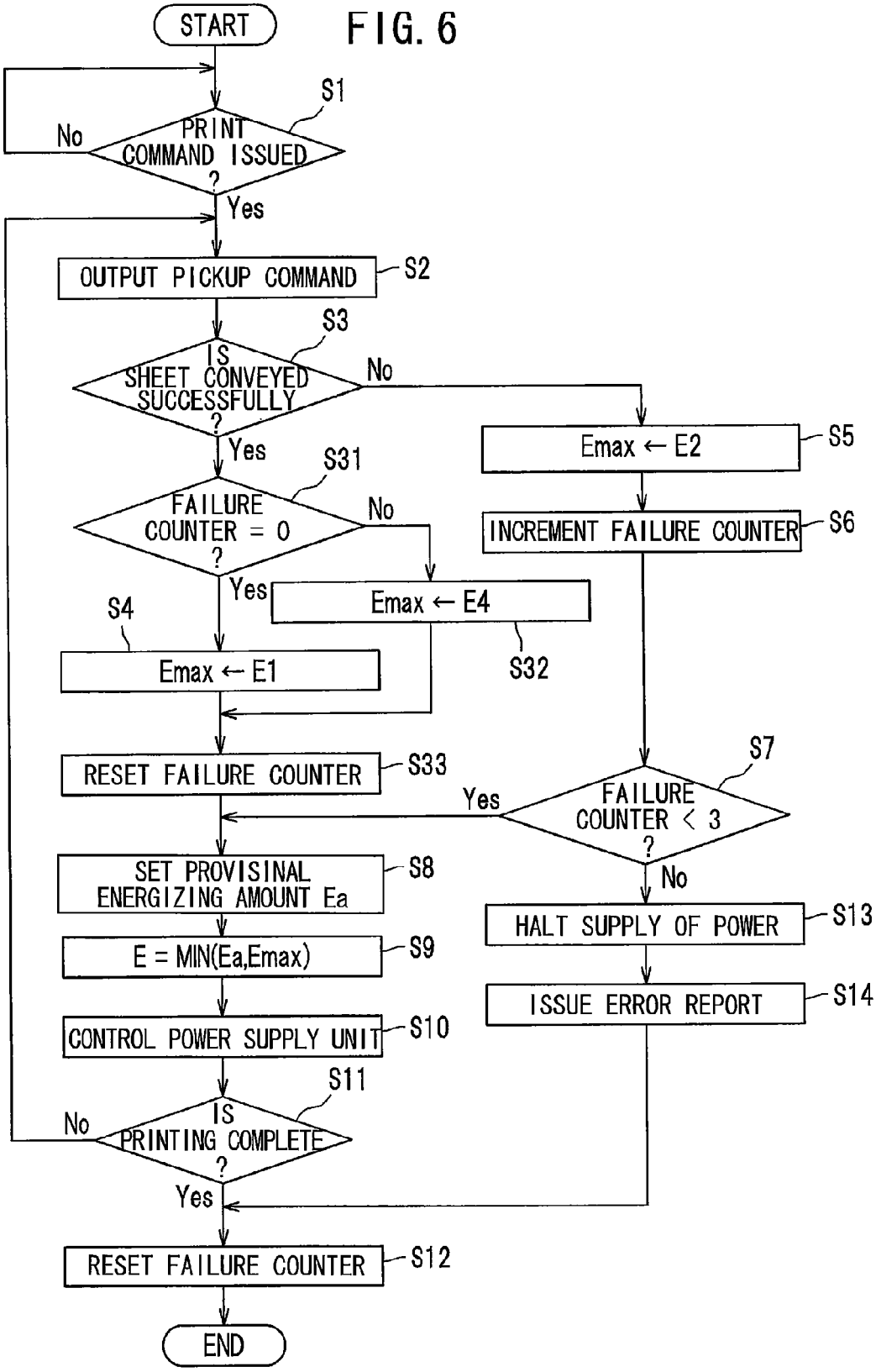
FIG. 6
START
S1
PRINT COMMAND ISSUED ?
No
Yes
OUTPUT PICKUP COMMAND
S2
S3
IS SHEET CONVEYED SUCCESSFULLY ?
No
Yes
S31
FAILURE COUNTER = 0 ?
No
Yes
Emax ← E4
S32
S4
Emax ← E1
RESET FAILURE COUNTER
S33
SET PROVISINAL ENERGIZING AMOUNT Ea
S8
E = MIN(Ea,Emax)
S9
CONTROL POWER SUPPLY UNIT
S10
S11
IS PRINTING COMPLETE ?
No
Yes
RESET FAILURE COUNTER
S12
END
Emax ← E2
S5
INCREMENT FAILURE COUNTER
S6
S7
FAILURE COUNTER < 3 ?
Yes
No
HALT SUPPLY OF POWER
S13
ISSUE ERROR REPORT
S14

IMAGE-FORMING APPARATUS SETTING UPPER LIMIT OF ELECTRIC POWER BASED ON DETECTION RESULT OF SHEET DETECTOR

CROSS REFERENCE TO RELATED APPLICATION

This application claims priority from Japanese Patent Application No. 2012-261989 filed Nov. 30, 2012. The entire content of the priority application is incorporated herein by reference.

TECHNICAL FIELD

The present invention relates to an image-forming apparatus having a non-contact temperature sensor for detecting the temperature of a heated body, and a temperature controller for controlling the temperature of the heated body based on the temperature detected by the sensor.

BACKGROUND

Since paper absorbs heat from a heating roller when passing over the same, a technique, disclosed in Japanese Patent Application Publication No. 2008-134377, was proposed to raise the output of the heating roller above its normal output before a sheet of paper reaches the roller to mitigate a decline in the temperature of the heating roller.

SUMMARY

However, this conventional technique, which increases heater output in anticipation of a drop in temperature as the sheet of paper is conveyed past the heating roller, risks the temperature of the heating roller becoming too high if the operation for conveying a sheet of paper from the paper tray fails.

Therefore, it is an object of the present invention to provide an image-forming apparatus capable of suppressing a large rise in the temperature of the heating roller when the conveyance of paper from a paper tray fails.

In order to attain the above and other objects, the invention provides an image-forming apparatus. The image-forming apparatus includes a sheet accommodating unit, an image forming unit, a pickup roller, a sheet detector, a fixing unit, a power supply unit, and a control device. The sheet accommodating unit is configured to accommodate a recording sheet. The image forming unit is configured to form an image on the recording sheet. The pickup roller is configured to convey the recording sheet accommodated in the sheet accommodating unit to the image forming unit. The sheet detector is configured to detect the recording sheet conveyed from the sheet accommodating unit by the pickup roller. The fixing unit includes a heating member configured to heat the recording sheet. The power supply unit is configured to supply the heating member with electric power. The control device is configured to: output a signal controlling the pickup roller to convey the recording sheet from the sheet accommodating unit; determine, based on a detection result of the sheet detector, whether the pickup roller succeeds in conveying the recording sheet from the sheet accommodating unit; control the power supply unit to supply the heating member with the electric power such that the electric power per unit time does not exceed an upper limit; and set the upper limit depending on a determination result of whether the pickup roller succeeds in conveying the recording sheet from the sheet accommodating unit.

BRIEF DESCRIPTION OF THE DRAWINGS

The particular features and advantages of the invention as well as other objects will become apparent from the following description taken in connection with the accompanying drawings, in which:

FIG. 2(*b*) is a perspective view of the sheet sensor when no sheet is at the position of the sheet sensor;

FIG. 6 is a flowchart illustrating a process for controlling the power supply unit according to another modification in which the upper limit is changed when a conveyance failure occurs and subsequently a conveyance is succeeded.

DETAILED DESCRIPTION

Figure 1:
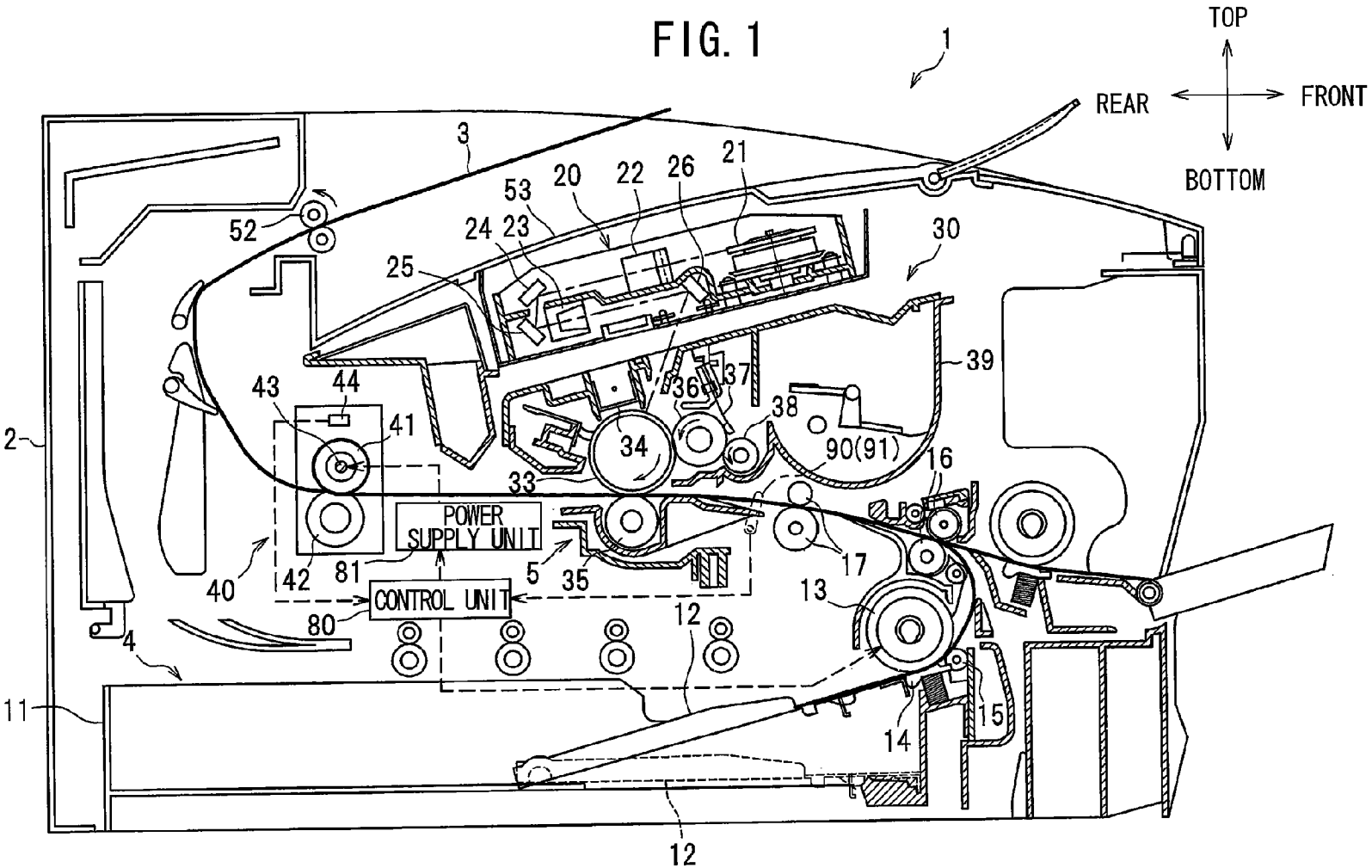
FIG. 1 is a cross sectional side view of a laser printer according to illustrative aspects of the invention.

A laser printer 1 according to embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the laser printer is disposed in an orientation in which it is intended to be used. In use, the laser printer 1 is disposed as shown in FIG. 1.

As shown in FIG. 1, the laser printer 1 includes a device body 2 and, within the device body 2, a feeding unit 4 for feeding sheets 3 of paper to be printed, and an image-forming unit 5 for forming images on sheets 3 supplied by the feeding unit 4.

The feeding unit 4 includes a paper tray 11 for accommodating the sheets 3, a paper-pressing plate 12 disposed in the paper tray 11 for urging the front side of the sheets 3 upward; a pickup roller 13 and a feeding pad 14 disposed above the front end of the paper tray 11; paper dust rollers 15 and 16 disposed downstream of the pickup roller 13 in the conveying direction of the sheet 3; and a pair of registration rollers 17 disposed downstream of the paper dust rollers 16.

In the feeding unit 4 having this configuration, sheets 3 are stacked in the paper tray 11. The paper-pressing plate 12 urges the front end of the sheets 3 toward the pickup roller 13. The pickup roller 13 and the feeding pad 14 cooperate to feed the sheets 3 one at a time from the paper tray 11, and the rollers 13-17 convey the sheets 3 to the image-forming unit 5.

Figure 2A:
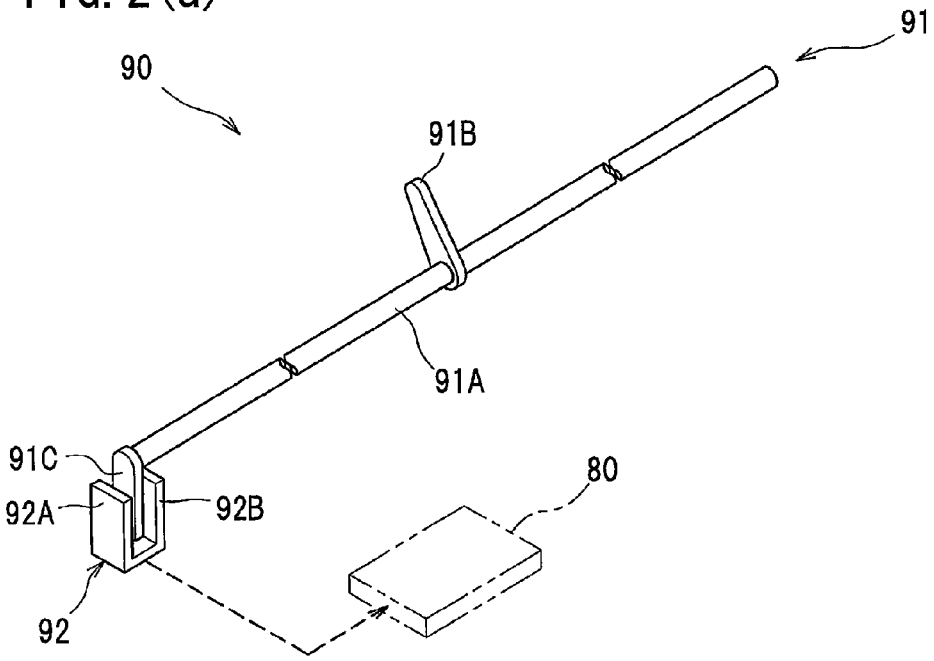
FIG. 2(*a*) is a perspective view of a sheet sensor when a sheet is at a position of the sheet sensor.
Figure 2B:
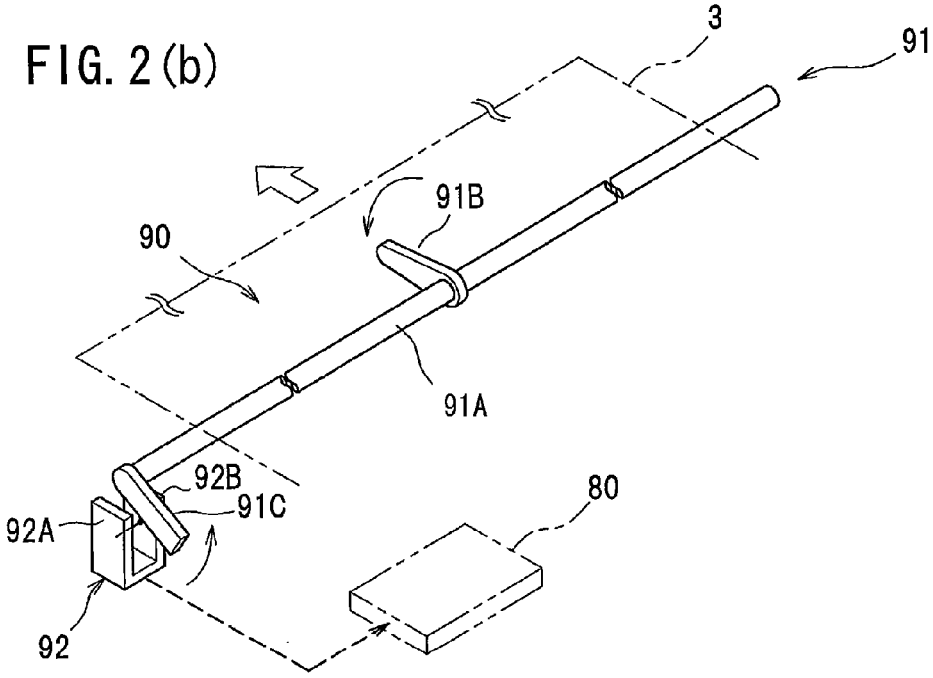

A sheet sensor 90 is disposed downstream of the registration rollers 17 in the conveying direction, and specifically between the registration rollers 17 and a photosensitive drum 33 described later. The sheet sensor 90 detects the presence of sheets 3 on the paper-conveying path. As shown in FIGS. 2(*a*) and 2(*b*), the sheet sensor 90 includes a pivoting member 91 that can pivot relative to the device body 2, and a photosensor 92 that detects the pivoting motion of the pivoting member 91.

The pivoting member 91 is configured of a pivoting shaft 91A rotatably supported in the device body 2, a contact part 91B that protrudes radially outward from the approximate center of the pivoting shaft 91A in the axial direction, and a light-shielding part 91C that protrudes radially outward from one end of the pivoting shaft 91A in the axial direction. The contact part 91B is erected upward so as to protrude into the paper-conveying path while a sheet 3 is not present (during a period of no print control) and pivots downward when contacted by a sheet 3 conveyed along the conveying path (during a period of print control).

The photosensor 92 has a light-emitting unit 92A for emitting light, and a light-receiving unit 92B for receiving light emitted from the light-emitting unit 92A. The photosensor 92 outputs prescribed signals to a control unit 80 provided in the device body 2 to indicate changes in the light-detection state of the light-receiving unit 92B.

More specifically, during a period of no print control, the light-shielding part 91C is positioned between the light-emitting unit 92A and the light-receiving unit 92B of the photosensor 92 (see FIG. 2(*a*)), preventing light emitted from the light-emitting unit 92A from reaching the light-receiving unit 92B. During a period of print control, the contact part 91B is pivoted downward through contact by the sheet 3, thereby moving the light-shielding part 91C out from between the light-emitting unit 92A and the light-receiving unit 92B (see FIG. 2(*b*)). The photosensor 92 is in an ON state while a sheet 3 is passing over the sheet sensor 90 (while the contact part 91B is pivoted downward) and in an OFF state while a sheet 3 is not passing over the sheet sensor 90 (while the contact part 91B is erected in the paper-conveying path.

As shown in FIG. 1, the image-forming unit 5 includes a scanning unit 20, a process cartridge 30, and a fixing unit 40.

The scanning unit 20 is disposed in the top section of the device body 2. The scanning unit 20 includes a laser light-emitting unit (not shown), a polygon mirror 21 that is driven to rotate, lenses 22 and 23, and reflecting mirrors 24, 25, and 26. The laser light-emitting unit of the scanning unit 20 irradiates a laser beam that follows the path indicated by a chain line in FIG. 1, and is irradiated onto the surface of a photosensitive drum 33 in the process cartridge 30 described below through a high-speed scan.

The process cartridge 30 is detachably mounted in the device body 2 at a position below the scanning unit 20. The process cartridge 30 includes the photosensitive drum 33, a scorotron charger 34, a transfer roller 35, a developing roller 36, a thickness-regulating blade 37, a supply roller 38, and a toner hopper 39.

In the process cartridge 30 having this construction, the scorotron charger 34 applies a charge to the surface of the photosensitive drum 33, and the scanning unit 20 subsequently irradiates a laser beam onto the surface to form an electrostatic latent image thereon. The supply roller 38 supplies toner from the toner hopper 39 onto the developing roller 36, and the developing roller 36 supplies the toner in turn onto the latent image to form a toner image on the surface of the photosensitive drum 33. The toner image is subsequently transferred onto a sheet 3 as the sheet 3 is conveyed between the photosensitive drum 33 and the transfer roller 35, forming an image on the sheet 3.

The fixing unit 40 functions to fix the toner image transferred onto the sheet 3 using heat. The fixing unit 40 includes a heating roller 41, a halogen lamp 43 provided inside in the heating roller 41, a pressure roller 42, and a thermistor 44.

The heating roller 41 is a cylindrical member. The halogen lamp 43 disposed inside the heating roller 41 generates heat that is transferred to the sheet 3 through the heating roller 41. A power supply unit 81 is provided in the device body 2 for supplying power to the halogen lamp 43, and the halogen lamp 43 generates heat upon receiving this power.

The pressure roller 42 is disposed in confrontation with the heating roller 41 and applies pressure to the same. With this configuration, a nip part is formed between the heating roller 41 and the pressure roller 42.

The thermistor 44 is a non-contact sensor that detects the temperature around the heating roller 41 (hereinafter called the "ambient temperature"). Thus, the thermistor 44 is separated from the surface of the heating roller 41.

In the fixing unit 40 having this construction, the heating roller 41 fixes a toner image on a sheet 3 with heat as the sheet 3 passes through the nip part between the heating roller 41 and the pressure roller 42. Following the fixing operation in the fixing unit 40, discharge rollers 52 disposed downstream from the fixing unit 40 discharge the sheet 3 onto a discharge tray 53 formed on the outside of the device body 2.

Control Unit

Next, the control unit 80 will be described in greater detail. The control unit 80 includes a CPU, a RAM, a ROM, and an input/output circuit, for example. The control unit 80 performs computations for controlling the paper-pressing plate 12, the pickup roller 13, the power supply unit 81, and the like based on input received from the sheet sensor 90 and the thermistor 44, the content of print commands, programs and data stored in ROM, and the like.

The structure of the control unit 80 is well known in the art. That is, the control unit 80 transmits a pickup signal to the paper-pressing plate 12 and the pickup roller 13 (and more accurately to a mechanism operating the paper-pressing plate 12 and the pickup roller 13) based on a print command or the like. In response to the pickup signal, the pickup roller 13 and the like convey sheets 3 one at a time from the paper tray 11.

The control unit 80 also corrects the temperature detected by the thermistor 44 using a prescribed function and controls the power supply unit 81 based on the corrected temperature and a target temperature (a temperature deemed suitable for fixing toner images on sheets 3). More specifically, the control unit 80 increases electric power per unit time outputted from the power supply unit 81. In the embodiment, to increase the electric power per unit time, the control unit 80 increases an energizing amount E per unit time outputted from the power supply unit 81 as the difference between the corrected temperature and the target temperature increases. Here, the energizing amount E per unit is an electric current outputted from the power supply unit 81. In other words, the control unit 80 increases the duty cycle of the power supply unit 81 for increasing the energizing amount E.

The control unit 80 considers the sheet 3 absorbing heat from the heating roller 41 as the sheet 3 passes through the nip part between the heating roller 41 and the pressure roller 42, a phenomenon that is well known in the art, and is configured to increase the energizing amount E outputted from the power supply unit 81 before the sheet 3 passes through the nip part. The timing at which the energizing amount E is increased can be set based on time elapsed after the control unit 80 has outputted a pickup signal, for example. This timing and the magnitude of the energizing amount E should be set to suitable values through experimentation, simulations, and the like.

The control unit 80 includes a function for determining whether the pickup roller 13 succeeded in conveying a sheet 3 from the paper tray 11 based on the pickup signal described above and detection results received from the sheet sensor 90. Specifically, the control unit 80 determines that conveyance of the sheet 3 was successful when the sheet sensor 90 is in an ON state a prescribed time after the pickup signal was outputted, and that conveyance of the sheet 3 failed when the sheet sensor 90 is in an OFF state at this prescribed time. The prescribed time is set to the amount of time required for an arbitrary section of the sheet 3 between the leading edge and the trailing edge to arrive at the sheet sensor 90 from the time the sheet 3 was fed from the paper tray 11. The prescribed time should be set to a suitable value found through experimentation, simulations, and the like.

In the present invention, the control unit 80 controls the power supply unit 81 such that the electric power per unit time outputted from the power supply unit 81 does not exceeds the upper limit. Here, the control unit 80 sets the upper limit depending on whether a sheet 3 is successfully conveyed from the paper tray 11. For controlling the electric power described above, the control unit 80 sets an upper limit Emax of the energizing amount E per unit time outputted from the power supply unit 81 to a first prescribed value E1 (100%, for example) when a sheet 3 is successfully conveyed from the paper tray 11, and sets the upper limit Emax to a second prescribed value E2 smaller than the first prescribed value E1 (40%, for example) when conveyance of the sheet 3 fails. By changing the upper limit Emax to the second prescribed value E2, which is smaller than the first prescribed value E1, when a sheet 3 could not be conveyed from the paper tray 11, the control unit 80 can mitigate the amount of power supplied to the heating roller 41 and the halogen lamp 43 since a sheet 3 has not been conveyed and will not absorb heat from the heating roller 41. In this way, the control unit 80 can prevent the temperature of the heating roller 41 and the halogen lamp 43 from becoming too high.

Before and during the operation to determine whether conveyance was successful, the control unit 80 may set the upper limit Emax in any of various ways. For example, the control unit 80 may set the upper limit Emax temporarily to the first prescribed value E1 prior to and during the operation to determine whether the conveyance was successful and may either maintain the upper limit Emax at the first prescribed value E1 after a determination of success or switch the upper limit Emax from the first prescribed value E1 to the second prescribed value E2 after a determination of failure. Alternatively, the control unit 80 may simply not set the upper limit Emax prior to and during the operation to determine whether conveyance was successful and may simply set the upper limit Emax to either the first prescribed value E1 or the second prescribed value E2 following the determination.

The control unit 80 also controls the power supply unit 81 to halt the supply of power to the halogen lamp 43 if conveyance of a sheet 3 fails three times in succession. By halting the supply of power after three failed attempts, the control unit 80 can more reliably prevent the temperature of the heated bodies (the heating roller 41 and the halogen lamp 43 in this example) from rising too high than when the power supply unit 81 continues to supply power regardless of the three failed attempts.

Further, when conveyance of a sheet 3 has failed three times in succession, the control unit 80 notifies the user of an error through an error notification unit (for example, a display device for displaying text, warning lamps, and sound-emitting devices, none of which are shown in the drawings).

The detailed process for controlling the power supply unit 81 by the control unit 80 will be explained with the flowchart of FIG. 3. In S1 of FIG. 3, the control unit 80 first determines whether a print command has been issued. If the control unit 80 determines that a print command has been issued (S1: YES), in S2 the control unit 80 outputs a pickup command to the pickup roller 13 and the like.

In S3 the control unit 80 determines whether the pickup roller 13 has successfully conveyed a sheet 3 by determining whether the sheet sensor 90 is in an ON state after the elapse of a prescribed time period since the pickup signal was outputted. If the control unit 80 determines that conveyance was a success (S3: YES), in S4 the control unit 80 sets the upper limit Emax of the energizing amount E outputted from the power supply unit 81 to the first prescribed value E1 and advances to S8.

However, if the control unit 80 determines that conveyance was a failure (S3: NO), in S5 the control unit 80 sets the upper limit Emax of the energizing amount E to the second prescribed value E2, which is smaller than the first prescribed value E1. In S6 the control unit 80 then increments a failure counter serving to count the number of failed conveyances.

In S7 the control unit 80 determines whether the failure counter is less than 3. If the failure counter is less than 3 (S7: YES), the control unit 80 advances to S8.

In S8 the control unit 80 sets a provisional energizing amount Ea based on a value obtained by correcting the temperature detected by the thermistor 44, and a target temperature. In S9 the control unit 80 compares the provisional energizing amount Ea set in S8 to the upper limit Emax set in either S4 or S5 and sets the energizing amount E to the smaller value. In other words, if the provisional energizing amount Ea is smaller than the upper limit Emax, in S9 the control unit 80 sets the energizing amount E to the provisional energizing amount Ea. If the provisional energizing amount Ea is greater than or equal to the upper limit Emax, in S9 the control unit 80 sets the energizing amount E to the upper limit Emax. Subsequently, in S10 the control unit 80 controls the power supply unit 81 to output the energizing amount E set in S9.

In S11 the control unit 80 determines whether printing is complete. For example, the control unit 80 determines that printing is complete if all sheets 3 have been printed when the print command includes content for printing a plurality of sheets 3. If the control unit 80 determines that printing is not complete (S11: NO), the control unit 80 returns to S2.

However, if the control unit 80 determines that printing is complete (S11: YES), in S12 the control unit 80 resets the failure counter and ends the current control process. Further, if the control unit 80 determines in S7 that the failure counter is 3 or greater (S7: NO), in S13 the control unit 80 controls the power supply unit 81 to halt the supply of power to the halogen lamp 43, in S14 issues an error report to the user through the error notification unit, and advances to S12. After resetting the failure counter in S12, the control unit 80 ends the current control process.

Next, the control process in FIG. 3 will be described for a sample print job, while referring to the timing chart in FIG. 4. In this example, a conveyance failure occurs three times in succession while sequentially printing a plurality of sheets 3.

Figure 4:
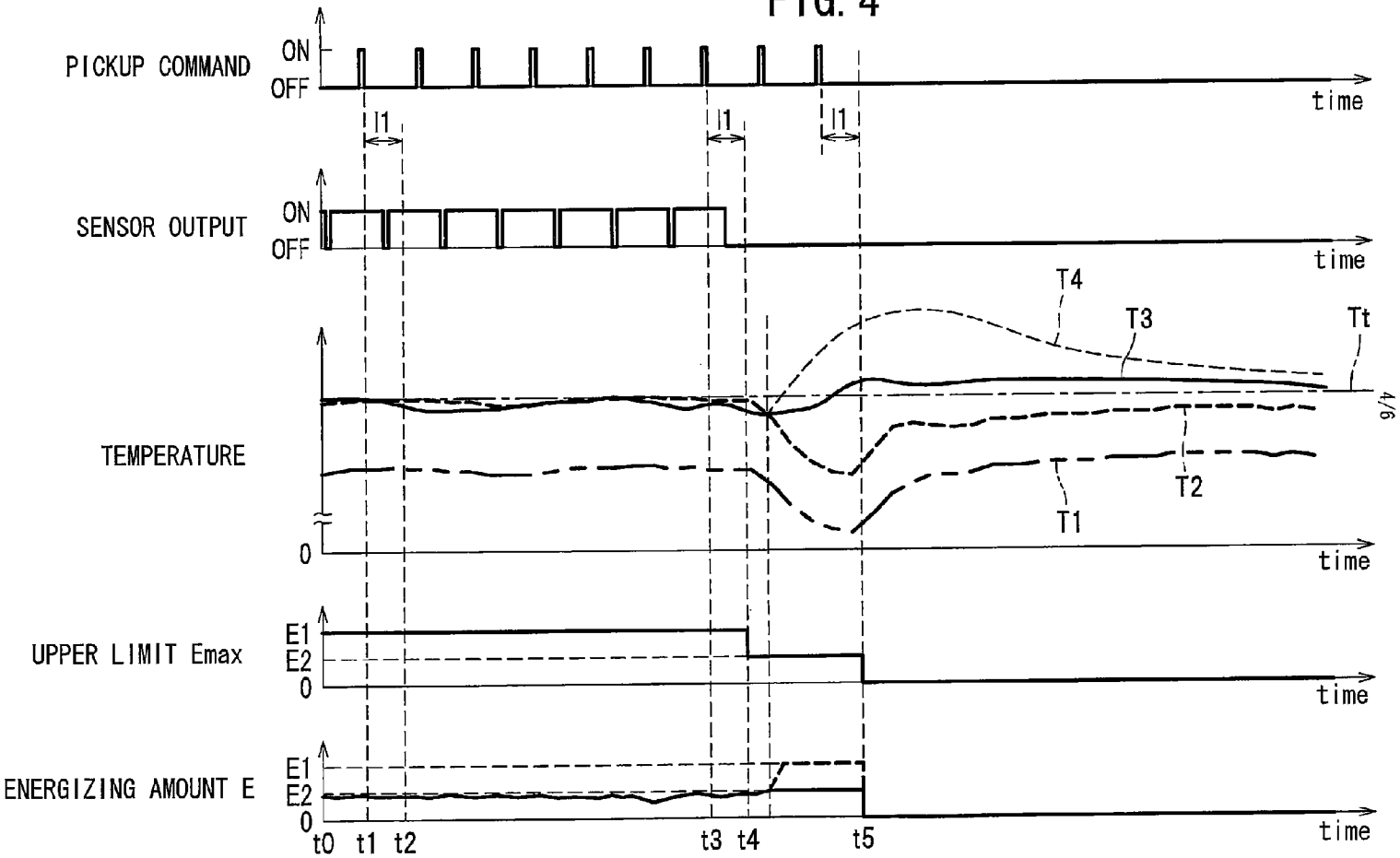
FIG. 4 is a timing chart when a conveyance failure occurs three times in succession.

In the example of FIG. 4, the control unit 80 outputs a pickup command at a time t1. At a time t2, a prescribed interval I1 (corresponding to the prescribed time period described in the above explanation about S2) after the control unit 80 outputted the pickup command, the output state of the sheet sensor 90 is ON. Based on this output state, it is clear that a sheet 3 was conveyed successfully. While sheets 3 are conveyed successfully in this way, an ambient temperature T1 (the temperature detected by the thermistor 44) indicated by a two-dot chain line in FIG. 4 maintains a nearly constant value, and a corrected temperature T2 indicated by a (bold) dashed line and obtained by correcting the ambient temperature T1 is approximately equal in value to the actual temperature T3 of the heating roller 41 indicated by a solid line. Since the corrected temperature T2 is comparable with a target temperature Tt indicated by a chain line, a suitable thermal fixing operation can be performed on the sheet 3.

Note that the upper limit Emax of the energizing amount E remains set to the first prescribed value E1 while sheets 3 are successfully conveyed. In the example of FIG. 4, the output state of the sheet sensor 90 is OFF at a time t4, which is the prescribed interval I1 after a pickup command was issued at a time t3. In this case, the control unit 80 determines that conveyance of a sheet 3 failed and changes the upper limit Emax from the first prescribed value E1 to the second prescribed value E2.

In the example of FIG. 4, the ambient temperature T1 drops after this failed conveyance (following the time t4) due to a disturbance, such as an air draft, producing a large difference between the corrected temperature T2 and the target temperature Tt. Using the conventional control method of maintaining the upper limit Emax at the first prescribed value E1 following a conveyance failure, the energizing amount E rises toward the first prescribed value E1 in order to bring the corrected temperature T2 closer to the target temperature Tt (indicated by the dashed line in the graph of the energizing amount), causing the actual temperature T4 of the heating roller 41 (indicated by a fine dashed line) to rise too high. In the preferred embodiment, on the other hand, if the ambient temperature T1 drops due to a draft or other disturbance following a failure to convey a sheet 3, resulting in a large difference between the corrected temperature T2 and the target temperature Tt, the energizing amount E is maintained at the second prescribed value E2, smaller than the first prescribed value E1 (indicated by the solid line in the graph of the energizing amount), thereby preventing the actual temperature T3 of the heating roller 41 from rising too high.

In the example of FIG. 4, the control unit 80 determines that three conveyance failures have occurred in succession at a time t5 and halts the supply of power from the power supply unit 81. This action prevents the actual temperature T3 of the heating roller 41 from continuing to rise after the three conveyance failures and, hence, prevents the actual temperature T3 of the heating roller 41 from rising too high better than when the power supply unit 81 continues to supply power even after three conveyance failures, for example.

While the invention has been described in detail with reference to a specific embodiment thereof, it would be apparent to those skilled in the art that many modifications and variations may be made therein, some of which are described below. In the following description, the laser printer 1 and its operations are configured similarly to those in the embodiment described above and, hence, like parts and like steps are respectively designated with the same reference numerals and step numbers to avoid duplicating description.

Figure 5:
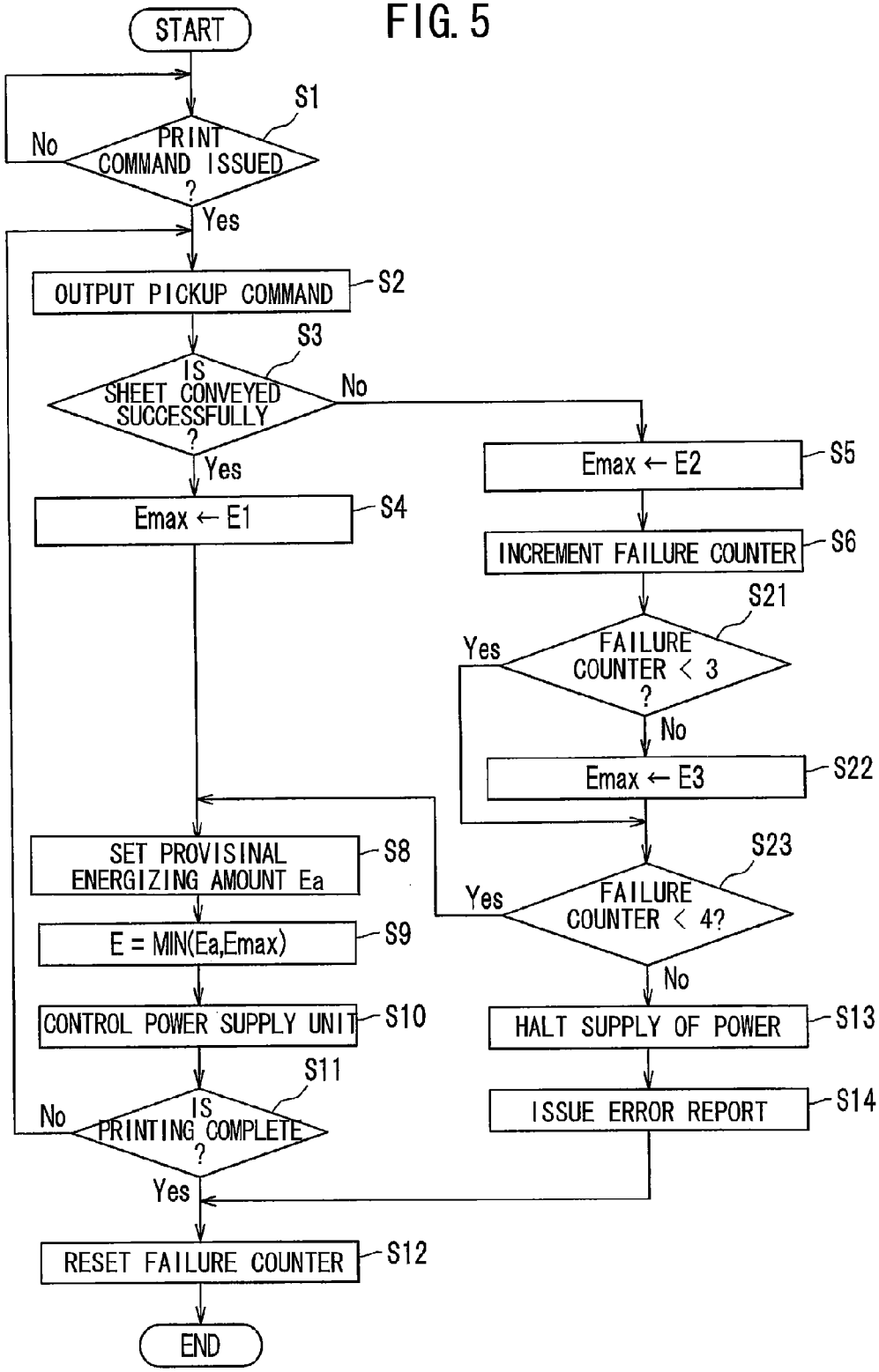
FIG. 5 is a flowchart illustrating a process for controlling the power supply unit according to a modification in which an upper limit is changed when a conveyance failure occurs three times.

The laser printer 1 in the embodiment described above is configured to halt the supply of power to the heated bodies when the pickup roller 13 fails to convey a sheet 3 three times. However, the present invention is not limited to this specific number of conveyance failures and may be applied to a method using any number of conveyance failures. In the example of FIG. 5, the control unit 80 halts the supply of power (S13) when conveyance of a sheet 3 has failed four times in succession (S23: NO). Further, the control unit 80 sets the upper limit Emax to a third prescribed value E3 smaller than the second prescribed value E2 prior to halting the supply of power if the number of successive failures reaches 3, as illustrated in FIG. 5.

Figure 3:
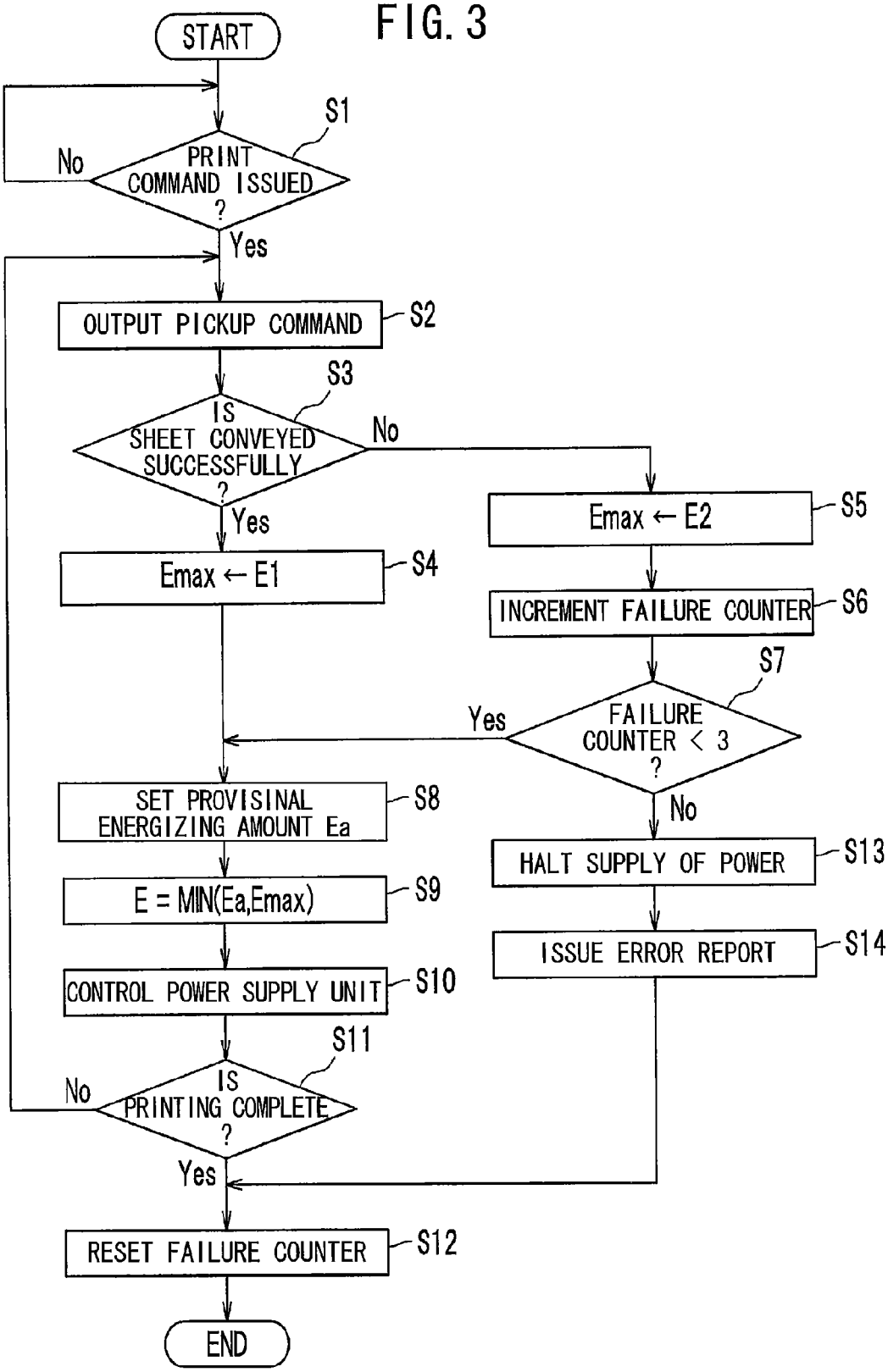
FIG. 3 is a flowchart illustrating a process for controlling a power supply unit.

That is, the flowchart in FIG. 5 includes a new step S23 in place of S7 in the flowchart of FIG. 3 described in the embodiment, wherein the value to which the failure counter is compared has been changed from 3 to 4, and further includes new steps S21 and S22 between steps S6 and S23. Next, the new steps S21-S23 will be described in greater detail.

In S21 the control unit 80 determines whether the failure counter is less than 3. If the failure counter is 3 or greater (S21: NO), in S22 the control unit 80 sets the upper limit Emax to the third prescribed value E3. After completing the process in S22 or when a YES determination was made in S21, the control unit 80 determines in S23 whether the failure counter is less than 4.

The control unit 80 advances to S8 when determining that the failure counter is less than 4 (S23: YES) and advances to S13 when determining that the failure counter is 4 or greater (S23: NO). As described above, the control unit 80 changes the upper limit Emax to the third prescribed value E3, which is smaller than the second prescribed value E2, when three conveyance failures have occurred in succession. Hence, this method better prevents the temperature of the heated bodies from rising too high than a method that maintains the upper limit Emax at the second prescribed value E2, for example.

While the control unit 80 always sets the upper limit Emax to the first prescribed value E1 in the embodiment when a sheet 3 was conveyed successfully, the present invention is not limited to this method. For example, the control unit 80 may set the upper limit Emax to a fourth prescribed value E4 (S32 of FIG. 6) smaller than the first prescribed value E1 and larger than the second prescribed value E2 when determining that the successful conveyance followed a conveyance failure (S31: NO), as illustrated in the flowchart of FIG. 6.

The flowchart shown in FIG. 6 includes new steps S31-S33 in addition to the steps described in the flowchart of FIG. 3. Below, the new steps S31-S33 will be described in detail.

When the control unit 80 determines in S3 that a sheet 3 was conveyed successfully (S3: YES), in S31 the control unit 80 determines whether the failure counter is set to 0. A failure counter of 0 indicates that the previous attempt to convey a sheet 3 also did not fail. When the failure counter is 0 (S31: YES), in S4 the control unit 80 sets the upper limit Emax to the first prescribed value E1.

However, if the failure counter is not 0, indicating that a failure occurred on the previous attempt to convey a sheet 3 (S31: NO), in S32 the control unit 80 sets the upper limit Emax to the fourth prescribed value E4. In S33 after performing either the process in S4 or the process in S32, the control unit 80 resets the failure counter and advances to S8.

The process in FIG. 6 is performed for the following reason. If a sheet 3 is conveyed successfully after a conveyance failure occurred on the previous attempt, the disparity between the ambient temperature and the temperature of the heated bodies could become great due to the effects of disturbances occurring at the time of the conveyance failure. Hence, if the upper limit Emax is abruptly returned from the second prescribed value E2 to the first prescribed value E1, this could cause the temperature of the heated bodies to rise too high. Thus, if a successful conveyance occurs after a failed conveyance in the flowchart of FIG. 6 (S3: YES, S31: NO), the control unit 80 sets the upper limit Emax to the fourth prescribed value E4, which is smaller than the first prescribed value E1, in order to prevent the temperature of the heated bodies from rising too high.

In the embodiment described above, the paper tray 11 is provided for holding a plurality of sheets, but the laser printer 1 may also include a manual feed tray holding only one sheet of paper, for example.

In the embodiment described above, the recording sheet is detected with the sheet sensor 90 having the pivoting member 91 and the photosensor 92, but recording sheets may be detected using only a photosensor, for example.

In the embodiment described above, the control unit 80 determines that a sheet 3 was conveyed successfully based on the pickup signal and the signal received from the sheet sensor 90. However, the control unit 80 may determine when conveyance is a success based on a signal from a sensor that detects a rise in the paper-pressing plate, and a signal from a sheet sensor on the conveying path, for example.

While recording sheets in the embodiment are described as sheets 3 of paper, which may include normal paper, heavy paper, postcards, and the like, the present invention may be applied to transparencies or other recording sheets as well.

While the heating roller 41 and the halogen lamp 43 serve as examples of the heated bodies in the embodiment, the present invention may be applied to heating resistors or induction heaters, for example. Here, while the induction heater itself does not produce heat, its electromagnetic-induction heating system can generate heat in rollers or metal belts.

While the present invention is applied to the laser printer 1 in the preferred embodiment, the present invention may be applied to other types of image-forming apparatuses, including copy machines and multifunction peripherals.

What is claimed is:

1. An image-forming apparatus comprising:

a sheet accommodating unit configured to accommodate a recording sheet;

an image forming unit configured to form an image on the recording sheet;

a pickup roller configured to convey the recording sheet accommodated in the sheet accommodating unit to the image forming unit;

a sheet detector configured to detect the recording sheet conveyed from the sheet accommodating unit by the pickup roller;

a fixing unit including a heating member configured to heat the recording sheet;

a power supply unit configured to supply the heating member with electric power; and a control device configured to:

output a signal controlling the pickup roller to convey the recording sheet from the sheet accommodating unit;

determine, based on a detection result of the sheet detector, whether the pickup roller succeeds in conveying the recording sheet from the sheet accommodating unit;

control the power supply unit to supply the heating member with the electric power such that the electric power per unit time does not exceed an upper limit; and set the upper limit depending on a determination result of whether the pickup roller succeeds in conveying the recording sheet from the sheet accommodating unit, wherein the control device is configured to:

set the upper limit to a prescribed first value when the pickup roller succeeds in conveying the recording sheet from the sheet accommodating unit; and set the upper limit to a prescribed second value smaller than the prescribed first value when the pickup roller fails in conveying the recording sheet from the sheet accommodating unit, wherein the control device is further configured to set the upper limit to a prescribed third value smaller than the second prescribed value when the pickup roller fails to convey the recording sheet from the sheet accommodating unit, consecutively, a predetermined number of times.

2. The image-forming apparatus according to claim 1, further comprising a temperature sensor configured to detect a temperature of the heating member, wherein the control device is configured to control the power supply unit based on the detected temperature.

3. The image-forming apparatus according to claim 2, wherein the temperature sensor includes a non-contact sensor separate from the heating member and configured to detect the temperature of the heating member.

4. The image-forming apparatus according to claim 1, wherein the control device is further configured to control the power supply unit to halt supply of the electric power when the pickup roller fails to convey the recording sheet from the sheet accommodating unit, consecutively, the predetermined number of times.

5. The image-forming apparatus according to claim 1, wherein the sheet detector includes a pivoting member and a light sensor detecting that the pivoting member pivots.

6. An image-forming apparatus comprising:

a sheet accommodating unit configured to accommodate a recording sheet;

an image forming unit configured to form an image on the recording sheet;

a pickup roller configured to convey the recording sheet accommodated in the sheet accommodating unit to the image forming unit;

a sheet detector configured to detect the recording sheet conveyed from the sheet accommodating unit by the pickup roller;

a fixing unit including a heating member configured to heat the recording sheet;

a power supply unit configured to supply the heating member with electric power; and a control device configured to:

output a signal controlling the pickup roller to convey the recording sheet from the sheet accommodating unit;

determine, based on a detection result of the sheet detector, whether the pickup roller succeeds in conveying the recording sheet from the sheet accommodating unit;

control the power supply unit to supply the heating member with the electric power such that the electric power per unit time does not exceed an upper limit; and set the upper limit depending on a determination result of whether the pickup roller succeeds in conveying the recording sheet from the sheet accommodating unit, wherein the control device is configured to:

set the upper limit to a prescribed first value when the pickup roller succeeds in conveying the recording sheet from the sheet accommodating unit; and set the upper limit to a prescribed second value smaller than the prescribed first value when the pickup roller fails in conveying the recording sheet from the sheet accommodating unit, wherein the control device is further configured to set the upper limit to a prescribed fourth value between the first prescribed value and the second prescribed value when the pickup roller fails to convey the recording sheet from the sheet accommodating unit and subsequently succeeds in conveying the recording sheet from the sheet accommodating unit.

7. The image-forming apparatus according to claim 6, further comprising a temperature sensor configured to detect a temperature of the heating member, wherein the control device is configured to control the power supply unit based on the detected temperature.

8. The image-forming apparatus according to claim 7, wherein the temperature sensor includes a non-contact sensor separate from the heating member and configured to detect the temperature of the heating member.

9. The image-forming apparatus according to claim 6, wherein the control device is further configured to control the power supply unit to halt supply of the electric power when the pickup roller fails to convey the recording sheet from the sheet accommodating unit, consecutively, a predetermined number of times.

10. The image-forming apparatus according to claim 6, wherein the sheet detector includes a pivoting member and a light sensor detecting that the pivoting member pivots.

* * * * *